US005529516A

United States Patent [19]

Wu et al.

[11] Patent Number: 5,529,516

[45] Date of Patent: Jun. 25, 1996

[54] ELECTRIC CONNECTOR ASSEMBLY

[76] Inventors: Yao-Deng Wu, No. 43 Ln. 114, Yuan Tung Nan Rd., Tan Tz Hsiang, Taichung County; Jun-Hsiung Zhen, No. 7 Alley 67, Ln. 168, Feng Dung Rd., Feng Yuan City, Taichung County, both of Taiwan

[21] Appl. No.: 359,748

[22] Filed: Dec. 20, 1994

[51] Int. Cl.[6] ..... H01R 11/09

[52] U.S. Cl. ..... 439/724; 439/654

[58] Field of Search ..... 439/724, 638, 439/645, 646, 650, 654

[56] References Cited

U.S. PATENT DOCUMENTS 3,315,219 4/1967 Brinser et al. ..... 439/724

5,310,364 5/1994 Hooper et al. ..... 439/724

*Primary Examiner*—Khiem Nguyen
*Assistant Examiner*—Yong Ki Kim
*Attorney, Agent, or Firm*—Morton J. Rosenberg; David I. Klein

[57] ABSTRACT

A connector includes one or more sockets engaged in a body for electrically connecting electric members together. The sockets each includes one side surface having two rooms for receiving contacts, and includes and upper surface and a lower surface each having two orifices for communicating with the rooms. One or more U-shaped conductors may engage with the contacts of the sockets so as to electrically connect the contacts together. Electrical members may be easily connected with each other without soldering processes.

3 Claims, 11 Drawing Sheets

ELECTRIC CONNECTOR ASSEMBLY

BACKGROUND OF THE INVENTION

1. Field of the Invention

The present invention relates to a connector, and more particularly to an electric connector assembly.

2. Description of the Prior Art

A typical electric switch means 30 is shown in FIGS. 10 and 11 and comprises a number of prongs 31 connected to a number of electric wires 60 which are connected to other electric wires 60 by connector caps 62. However, the wires 60, 61 are required to be treated with wire cutter and stripping tool so as to electrically connect the wires 60, 61 and the prongs 31 together. In addition, soldering processes are further provided for securing the wires 60 to the prongs 31. This is time consuming.

The present invention has arisen to mitigate and/or obviate the afore-described disadvantages of the conventional electric connectors.

SUMMARY OF THE INVENTION

The primary objective of the present invention is to provide an electric connector assembly for easily connecting electric conductors.

In accordance with one aspect of the invention, there is provided a connector assembly comprising a body including at least one space formed therein, at least two sockets for engaging in the space of the body, the sockets each including at least one side surface having at least one room formed therein, and the sockets each including an upper surface and a lower surface each having at least one orifice formed therein for communicating with the room, contact means engaged in the rooms, and means for securing the sockets in the body.

The body includes at least one pair of boards disposed in parallel with each other so as to define the space, and includes at least one pair of panels extended in parallel from the boards so as to define a second space.

Conductor means are further provided for connecting the contacts means of the sockets together.

The contact means includes a plurality of Z-shaped contacts each having two resilient blades for engaging with the body, the contacts each includes at least one extension extended from the blade.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
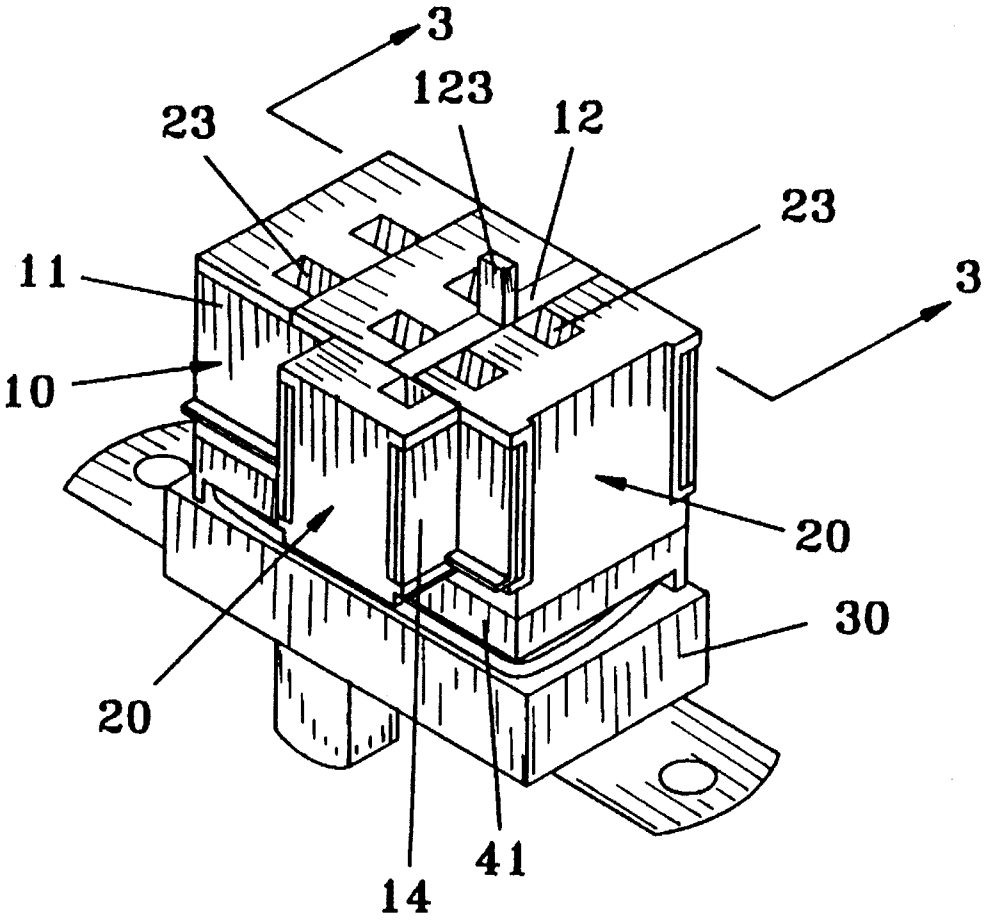
FIG. 1 is a perspective view of an electric connector assembly in accordance with the present invention.

Referring to the drawings, and initially to FIGS. 1 to 4, an electric connector assembly in accordance with the present invention comprises a body 10 and a number of sockets 20 secured in the body 10. The body 10 includes a pair of boards 11 having a partition plate 12 secured between the boards 11 so as to form two spaces for engaging with the sockets 20. The boards 11 each includes two ends having hooks 13 provided thereon for engaging with and for retaining the sockets 20 within the body 10. The partition plate 12 includes two holes 120 formed therein. The sockets 20 each includes two side surfaces, in which one side surface has two projections 121 for engaging with the holes 120 and the other side has two holes 210 for engaging with the projections 121 such that the sockets 20 may further be solidly secured in the body 10. A pair of panels 14 are secured to one of the boards 11 and arranged in parallel with each other so as to form another space for receiving another socket 20 therein. The partition plate 12 may further include a projection 123 extended upward therefrom for engaging with other object.

Figure 7:
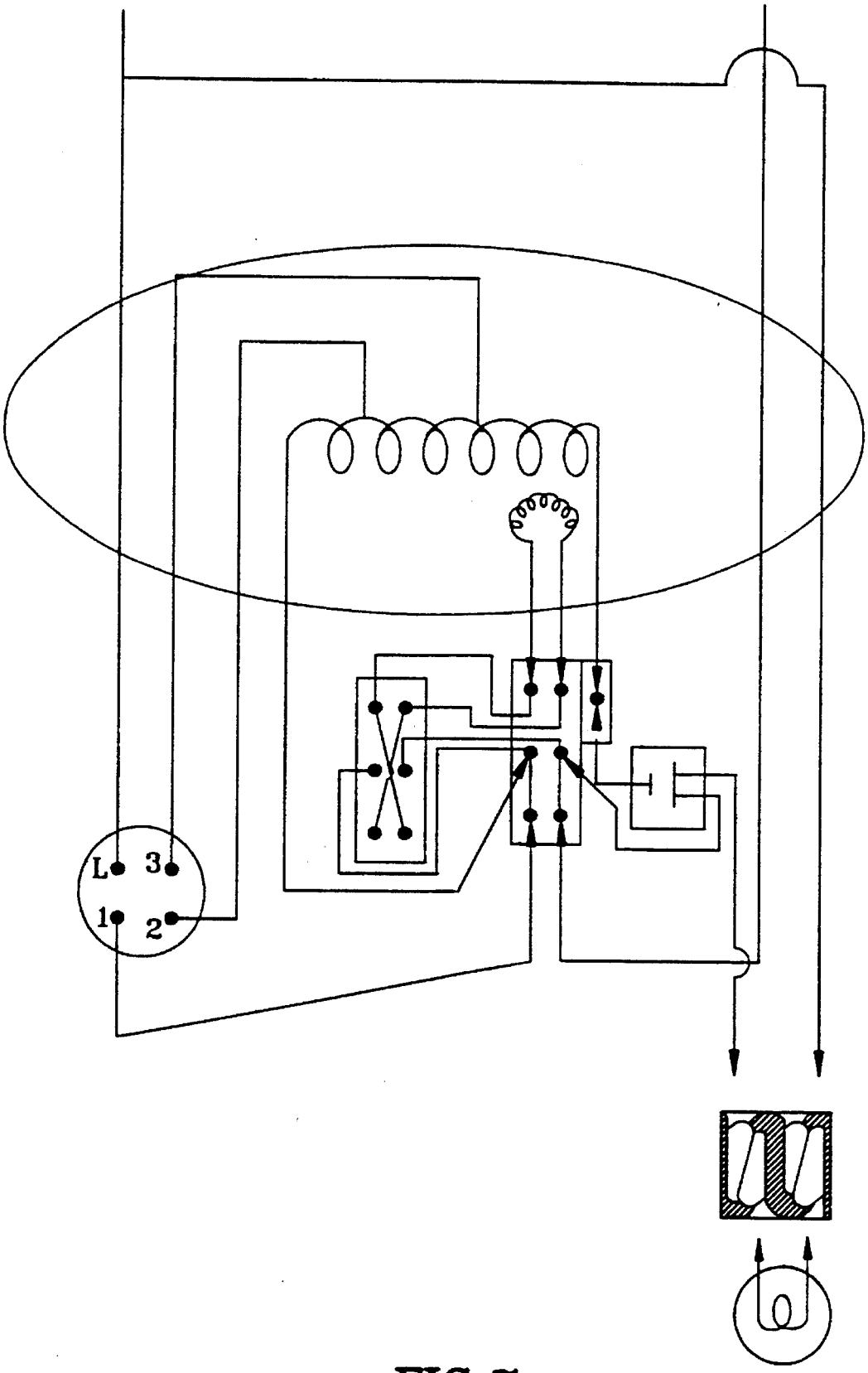
FIG. 7 is an electric diagram illustrating a circuit employing the electric connector assembly.
Figure 8:
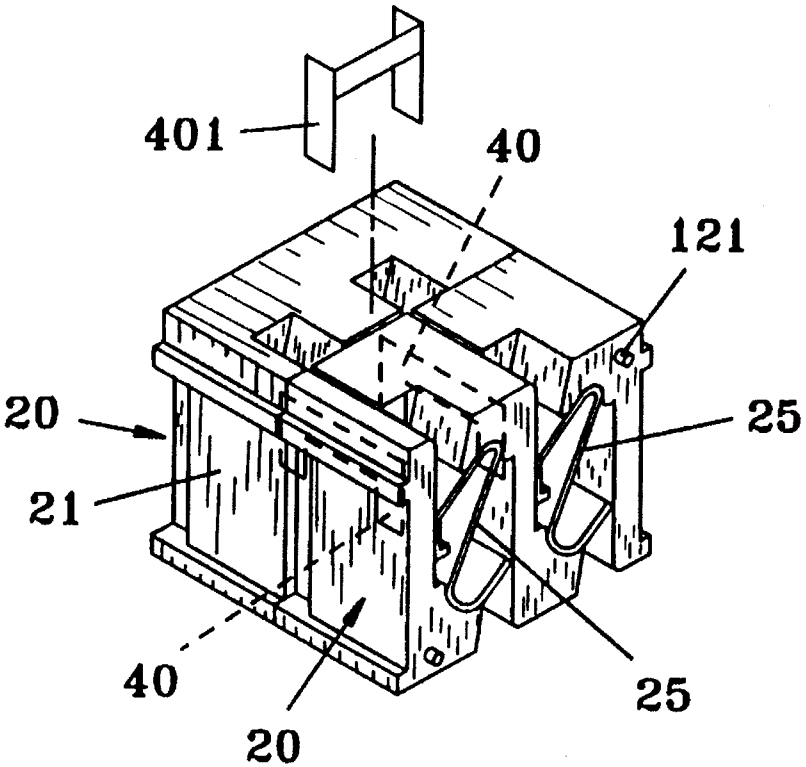
FIG. 8 is a perspective view showing another application of the conductor.
Figure 9:
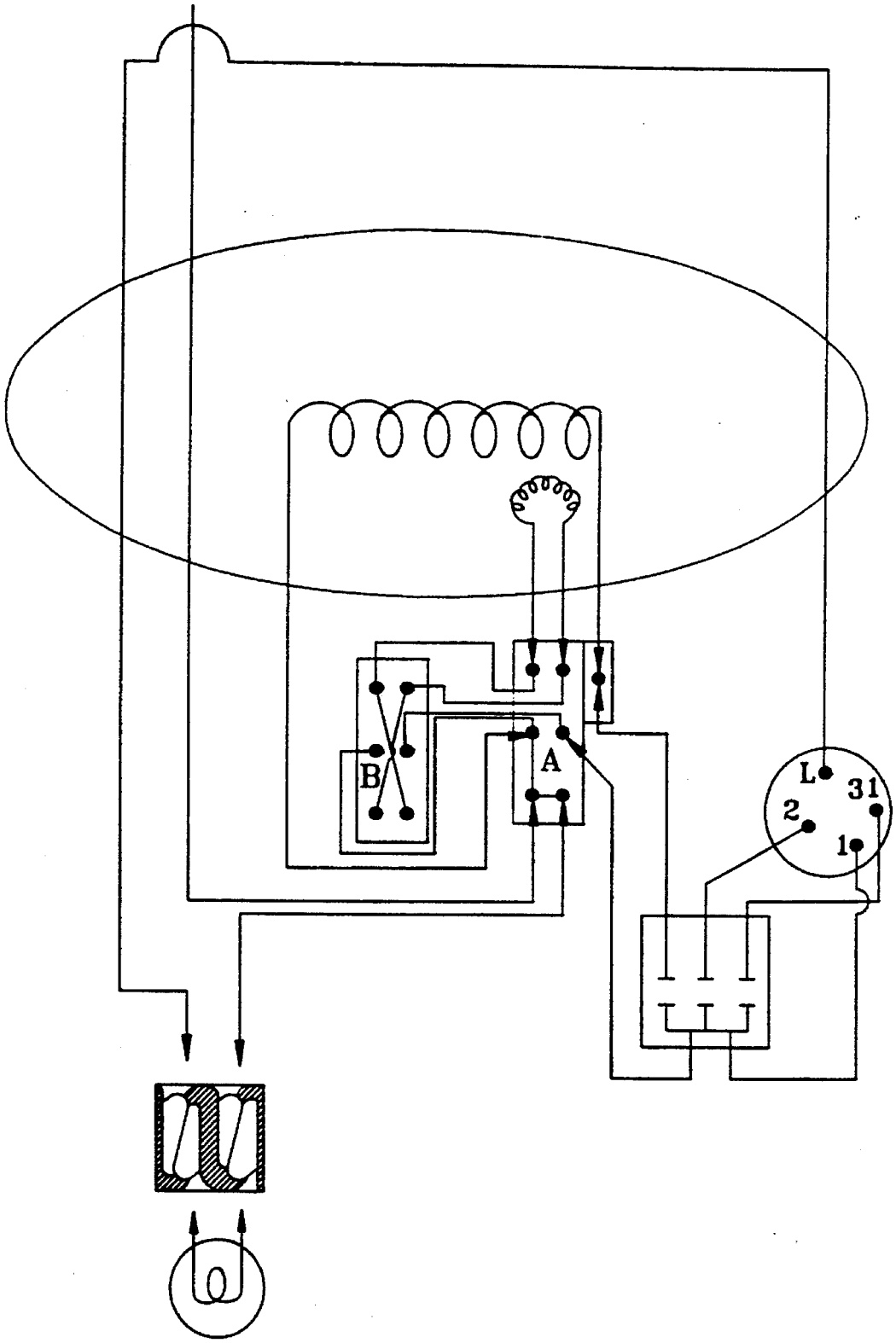
FIG. 9 is an electric diagram illustrating a circuit employing the electric connector assembly.
Figure 10:
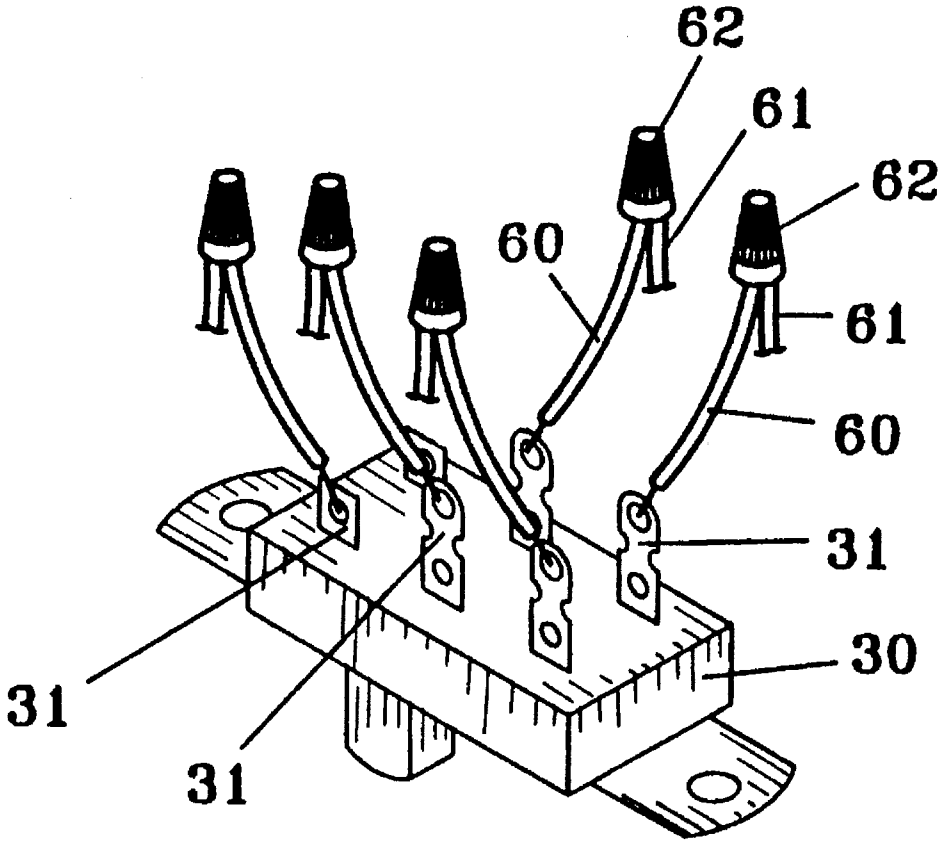
FIG.10 PRIOR ART
FIG. 10 is a perspective view showing a typical switch connected to wires.
Figure 11:
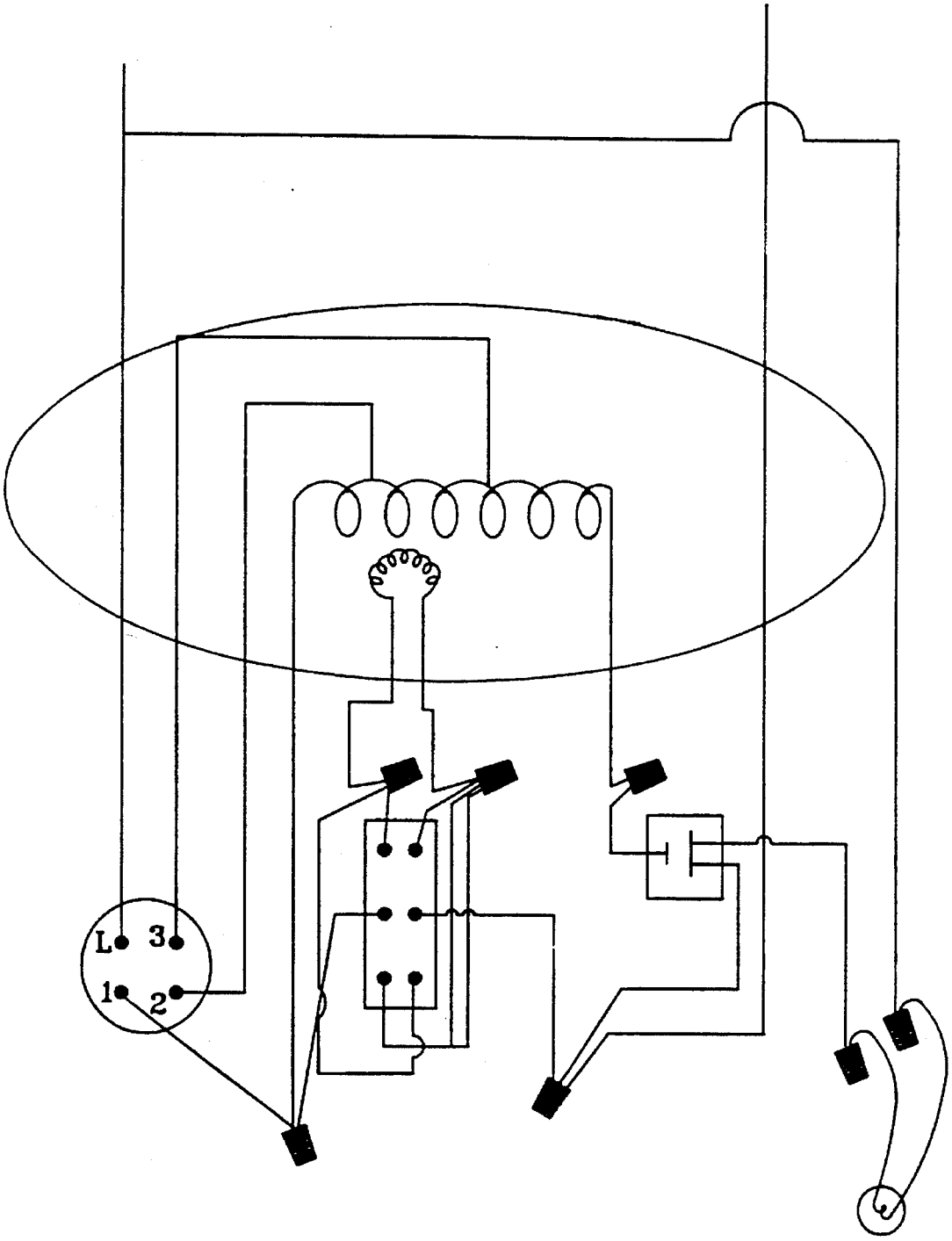
FIG.11 PRIOR ART
FIG. 11 is a schematic view illustrating the connection of the wires to the typical switch.

The sockets 20 each includes a body 21 having two rooms 22 formed in one side surface thereof for receiving Z-shaped contacts 25 therein, and each includes two shoulders 211 formed therein for engaging with the hooks 13 of the boards 11. The sockets 20 each includes four orifices 23 formed in the upper and bottom portions respectively for communicating with the rooms 22 and for communicating with the contacts 25. The rooms 22 each includes two seats 24 formed therein for engaging with two blades 250 of the contacts 25. One of the blades 250 includes an extension 251 extended therefrom and having a flange 252 laterally extended therefrom. Two U-shaped conductors 40 may be provided for connecting the contacts 25 of two sockets 20 together, best shown in FIGS. 2 and 4. The application of the conductors 40 in an electric circuit is shown in FIG. 7. Another type of conductor 401 (FIG. 8) may be provided for connecting the contacts 25 of each socket 20 together. The application of the conductors 401 in an electric circuit is shown in FIG. 9.

Referring again to FIGS. 1 and 2, when the connector assembly in accordance with the present invention is provided for engaging with a switch 30 having a number of prongs 31 provided thereon, a frame 41 is first engaged on the switch 30 for encircling the prongs 31. The prongs 31 each includes at least one hole 310 formed therein. The prongs 31 are then engaged through the orifices 23 for engaging with the contacts 25 and the prongs 3 may be stably retained in the sockets 20 by the resilient blades 250 of the contacts 25. When the prongs 31 are engaged with the blades 250 that have extensions 25 extended therefrom, the prongs 31 are engaged between the extensions 251 and the inner surfaces of the rooms 22 such that the prongs 31 may be easily disengaged from the sockets 20. The extensions 251 may further include a bulge formed thereon for engaging with the holes 310 of the prongs 31 so as to retain the prongs in place.

Figure 2:
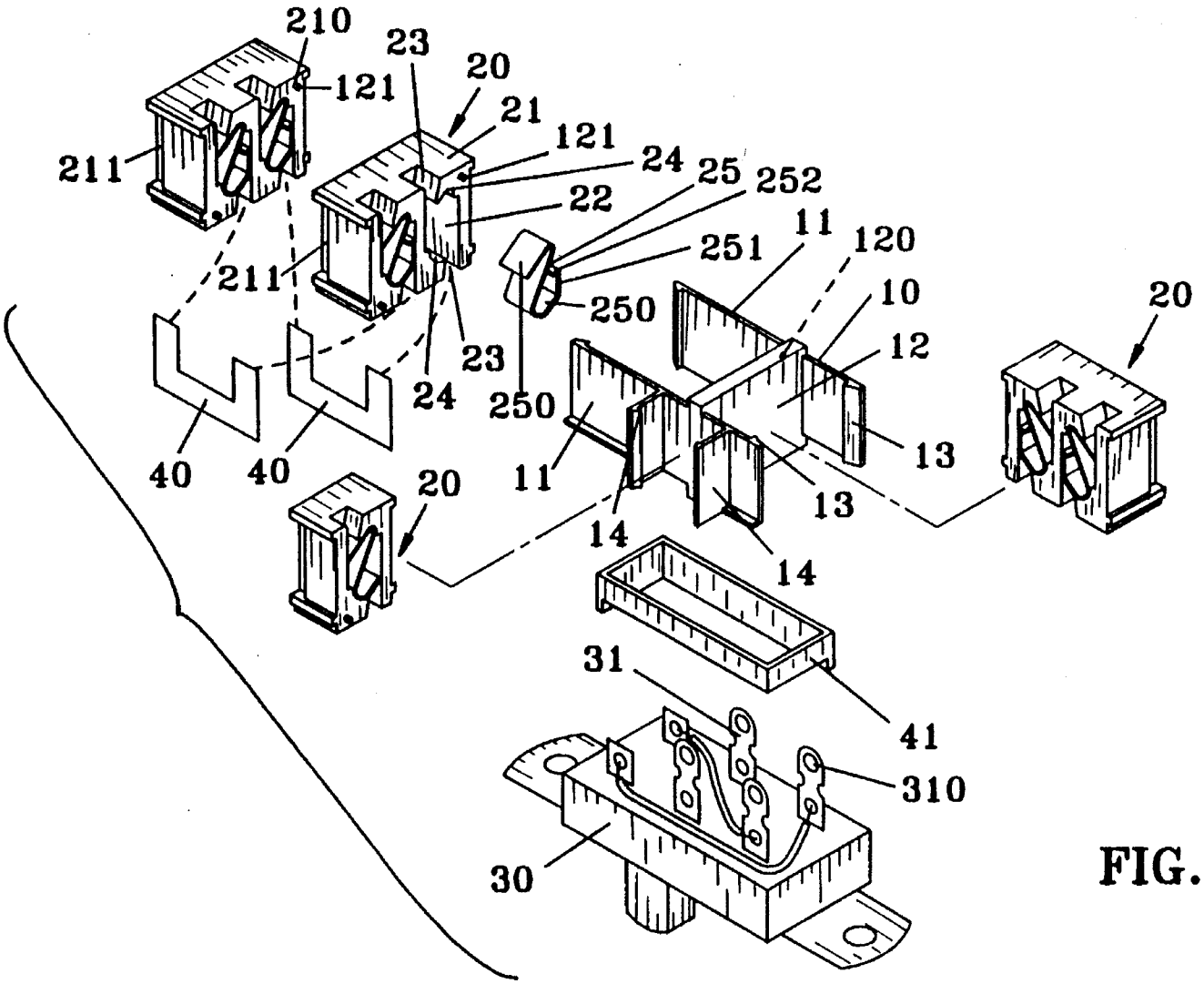
FIG. 2 is an exploded view of the electric connector assembly.
Figure 3:
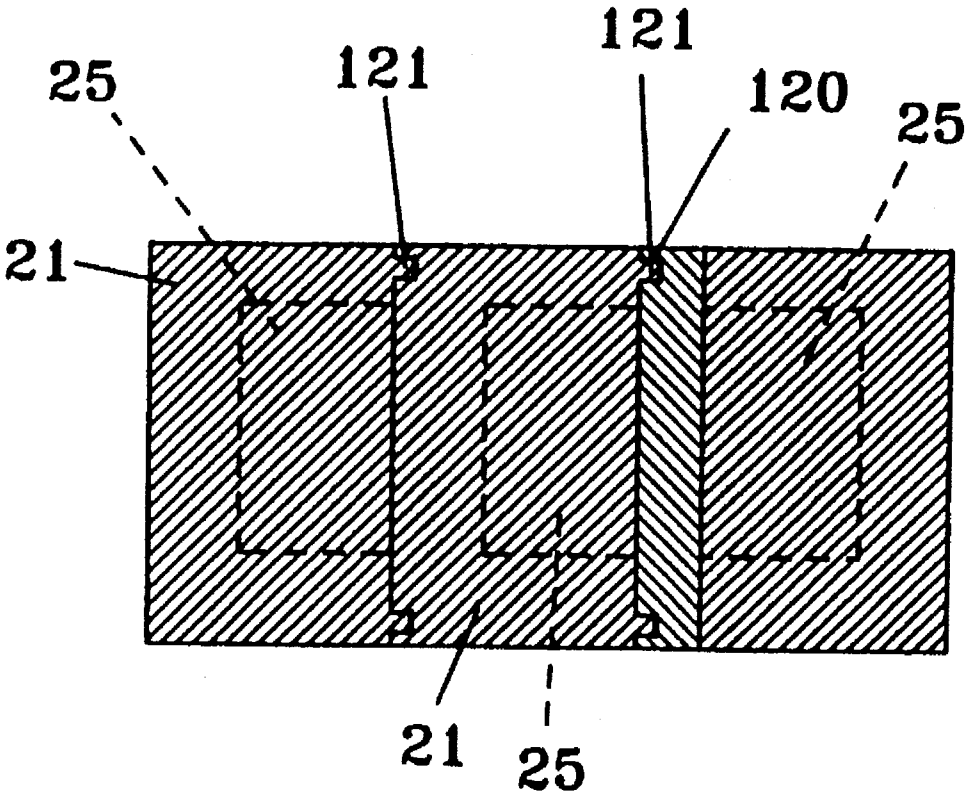
FIG. 3 is a cross sectional view taken along lines 3—3 of FIG. 1.
Figure 4:
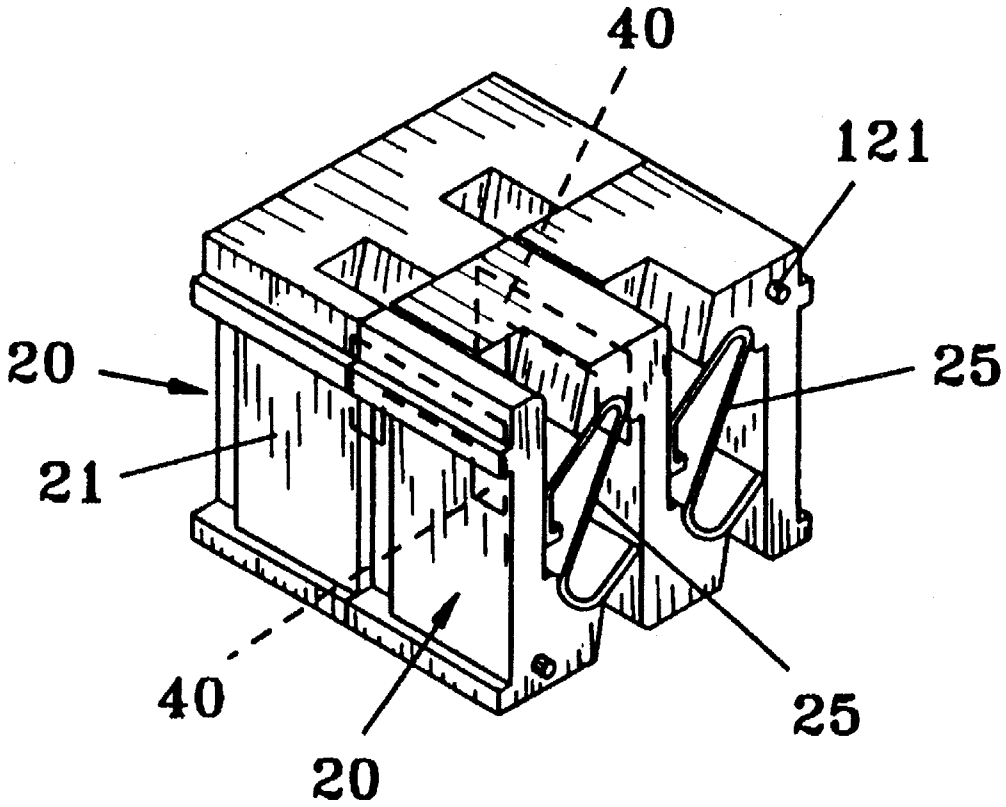
FIG. 4 is a perspective view illustrating portion of the electric connector assembly.
Figure 5:
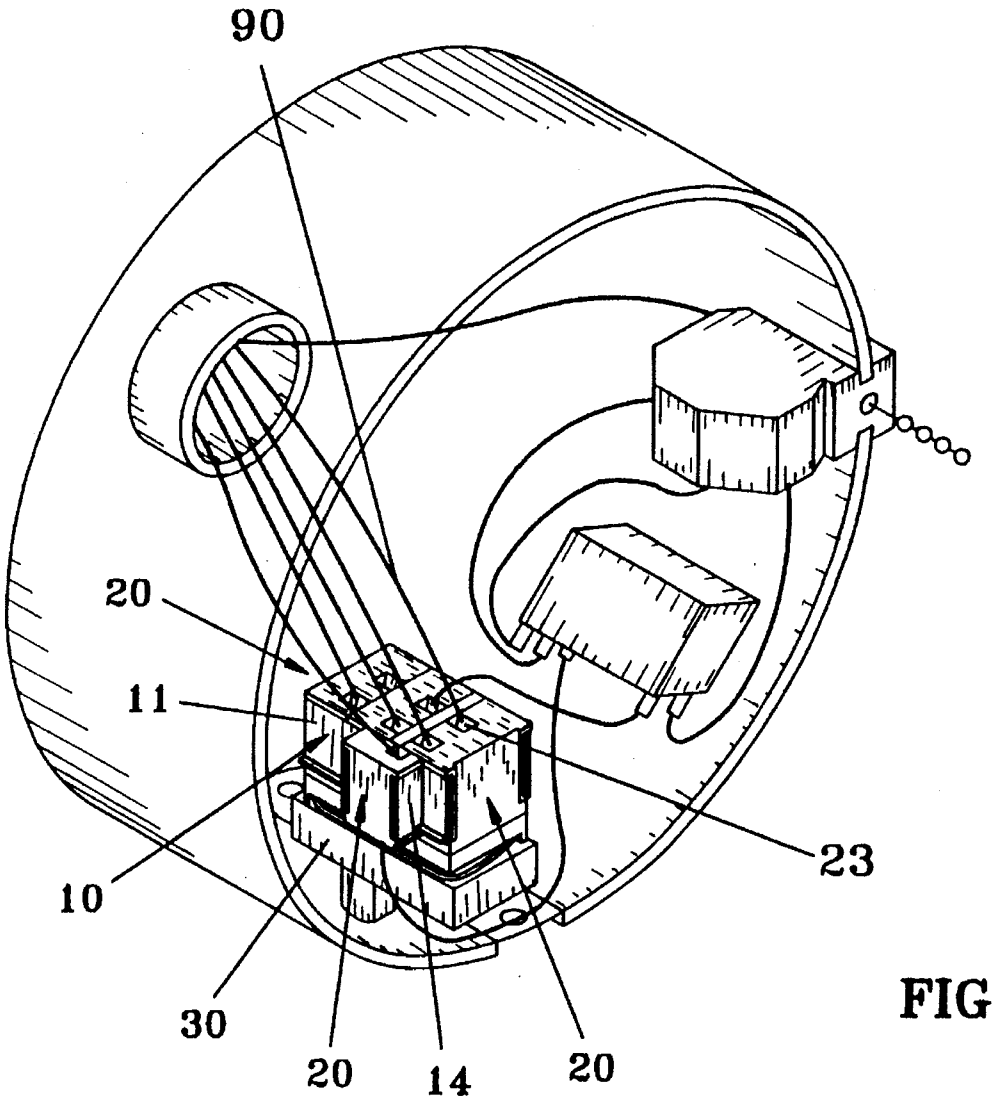
FIGS. 5 and 6 are perspective views illustrating two applications of the electric connector assembly.

Referring next to FIG. 5, when the free ends of the electric wires 90 are engaged in the orifices 23 of the sockets 20, the free ends may be stably retained in place by the resilient blades 250 of the contacts 25, shown in FIG. 2.

Figure 6:
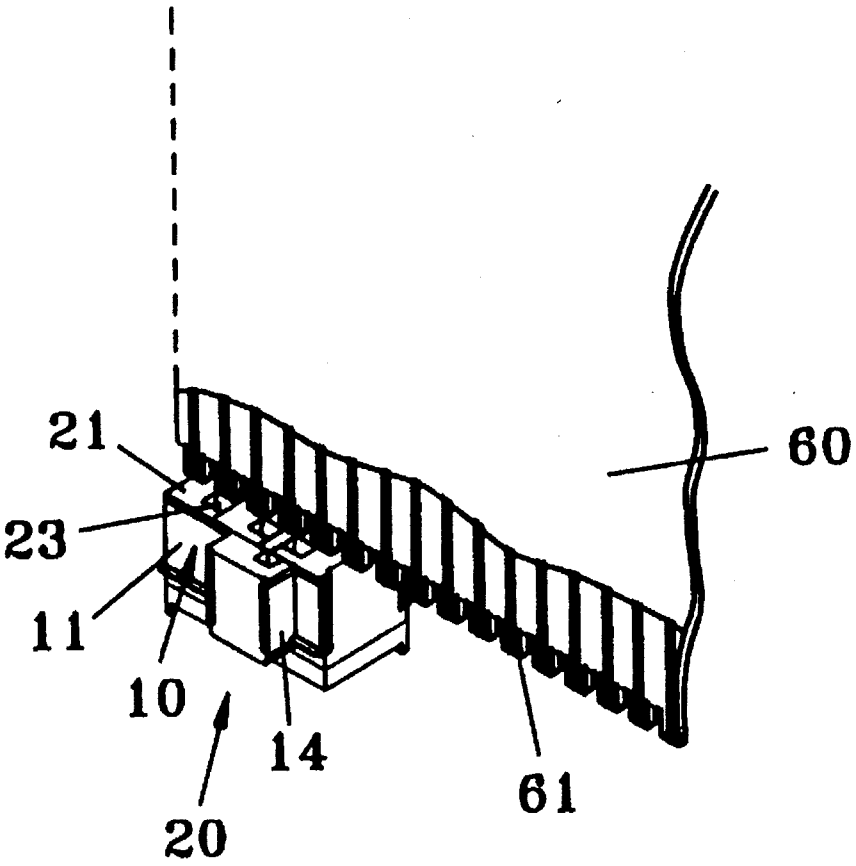

Referring next to FIG. 6, the inserts 61 of an electric board 60 may also be plugged into the orifices 23 of the sockets 20 for electrically connecting to other objects.

Accordingly, the electric connector assembly in accordance with the present invention may be provided for connecting electric members without welding or soldering processes. The electric members may be easily coupled together with the electric connector assembly.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A connector assembly comprising:

a body having at least one space formed therein, said body including (1) at least one pair of boards disposed in parallel relationship one with respect to another to define said space, and (2) at least one pair of panels extending in parallel relationship from one of said boards to define a second space;

at least two sockets for engagement within said space of said body, said two sockets each including at least one side surface having at least one room formed therein, and said two sockets each including an upper surface and a lower surface each having at least one orifice formed therein for communicating with said room;

contact means engaged in said rooms; and, means for securing said sockets in said body.

2. A connector assembly according to claim 1 further comprising conductor means for connecting said contacts means of said sockets together.

3. A connector assembly comprising:

a body having at least one space formed therein;

at least two sockets for engagement within said space of said body, said two sockets each including at least one side surface having at least one room formed therein, and said two sockets each including an upper surface and a lower surface each having at least one orifice formed therein for communicating with said room;

contact means engaged in said rooms, said contact means including a plurality of Z-shaped contacts each having two resilient blades for engaging with said body, said contacts each includes at least one extension extending from said blade; and, means for securing said sockets in said body.

* * * * *